US012185820B2

(12) United States Patent
Xu

(10) Patent No.: US 12,185,820 B2
(45) Date of Patent: Jan. 7, 2025

(54) BACKPACK WITH DISPLAY BOARD

(71) Applicant: Jax Enterprises LLC, City of Industry, CA (US)

(72) Inventor: Shawn Xu, City of Industry, CA (US)

(73) Assignee: Jax Enterprises LLC, City of Industry, CA (US)

( * ) Notice: Subject to any disclaimer, the term of this patent is extended or adjusted under 35 U.S.C. 154(b) by 130 days.

(21) Appl. No.: 17/877,370

(22) Filed: Jul. 29, 2022

(65) Prior Publication Data

US 2024/0032675 A1 Feb. 1, 2024

(51) Int. Cl.

| | |
|---|---|
| ***A45F 3/04*** | (2006.01) |
| ***A45C 5/03*** | (2006.01) |
| ***A45C 15/00*** | (2006.01) |
| ***A45F 3/00*** | (2006.01) |

(52) U.S. Cl.

CPC ..... *A45F 3/04* (2013.01); *A45C 5/03* (2013.01); *A45C 15/00* (2013.01); *A45C 2200/10* (2013.01); *A45F 2003/003* (2013.01)

(58) Field of Classification Search

CPC ..... A45F 3/04; A45F 2003/003; A45C 5/03; A45C 15/00; A45C 2200/10; A45C 13/08

USPC ..... 190/102

See application file for complete search history.

(56) References Cited

U.S. PATENT DOCUMENTS

| | | | | |
|---|---|---|---|---|
| 2,916,841 | A * | 12/1959 | Denis | A45C 3/06 40/716 |
| 5,222,642 | A | 6/1993 | Solarz | |
| 6,393,745 | B1 * | 5/2002 | Miki | G09F 27/00 224/655 |
| D673,362 | S * | 1/2013 | Presman | D3/217 |
| 9,877,558 | B1 * | 1/2018 | Harstvedt | A45C 3/00 |
| 10,813,436 | B2 * | 10/2020 | Hall | H04N 1/00344 |
| 2005/0264543 | A1 | 12/2005 | Gorischek | |
| 2006/0113203 | A1 | 6/2006 | Daley | |
| 2007/0201201 | A1 | 8/2007 | Daley, III | |
| 2009/0107021 | A1 * | 4/2009 | Koeppel | A45C 13/02 428/542.2 |
| 2012/0241059 | A1 * | 9/2012 | Wilson | A45C 13/08 150/105 |
| 2013/0032502 | A1 * | 2/2013 | Anderson | A45C 13/08 206/457 |
| 2014/0001079 | A1 * | 1/2014 | Green | A45F 3/04 206/320 |

(Continued)

OTHER PUBLICATIONS

International Searching Authority, International Application No. PCT/US22/44004, International Search Report and Written Opinion dated Jan. 17, 2023, 9 pages.

*Primary Examiner* — Don M Anderson
*Assistant Examiner* — Justin Caudill
(74) *Attorney, Agent, or Firm* — Polsinelli PC

(57) ABSTRACT

A bag having a housing structure of the bag forming a cavity in the bag, a display board removably secured to a board securing mechanism, wherein the board securing mechanism is disposed in the cavity in the bag, and a display shell attached to the housing structure by a fastening mechanism, wherein the fastening mechanism is operable to transition the display shell between an open configuration and a closed configuration, wherein in the open configuration the display shell is positioned to allow access to the display board, and wherein in the closed configuration the display shell is positioned to prevent access to the display board.

17 Claims, 6 Drawing Sheets

(56) References Cited

U.S. PATENT DOCUMENTS

| | | | | |
|---|---|---|---|---|
| 2015/0289629 | A1 | 10/2015 | Nakamura | |
| 2016/0338472 | A1* | 11/2016 | Donahue | A45F 3/042 |
| 2018/0325245 | A1 | 11/2018 | Assa-Darko | |
| 2019/0239612 | A1* | 8/2019 | McManus | A45C 7/0036 |

* cited by examiner

BACKPACK WITH DISPLAY BOARD

TECHNICAL FIELD

The present technology relates to a backpack with a display board and, more particularly, to a backpack having a clear shell and a display board configured to receive ornamental attachments thereto.

BACKGROUND

Consumers often carry day-to-day items and belongings in an accessory, such as a backpack. While there are many backpacks available to the public, many modern backpacks can be similar to other backpacks on the market. Many consumers typically enjoy a sense of individualism and desire to demonstrate their individuality. However, typical accessories are catered to mass manufacturing, such that the accessories become commonplace.

SUMMARY

In one aspect, a bag can include a housing structure of the bag forming a cavity in the bag, a display board removably secured to a board securing mechanism wherein the board securing mechanism is disposed in the cavity in the bag, and a display shell attached to the housing structure by a fastening mechanism, wherein the fastening mechanism is operable to transition the display shell between an open configuration and a closed configuration, wherein in the open configuration the display shell is positioned to allow access to the display board, and wherein in the closed configuration the display is positioned to prevent access to the display board.

In another aspect, the display board divides the cavity into a first cavity portion and a second cavity portion, wherein the first cavity portion is defined by the housing structure, the display board, and the display shell, and wherein the bag can further include a second fastening mechanism along at least one wall of the housing structure, wherein the second fastening mechanism is operable to permit access to the second cavity portion, wherein the second cavity portion is defined by the housing structure and the display board.

In another aspect, the display shell is transparent.

In another aspect, the display board can include a plurality of attachment points disposed thereon, wherein the plurality of attachment points are configured to receive and secure an ornamental accessory to the display board.

In another aspect, the bag can further include a hinge mechanism disposed on the housing structure, the hinge mechanism configured to rotate the display shell between the open configuration and the closed configuration by axial rotation along an axis defined along a length of the hinge mechanism.

In another aspect, the bag is a suitcase.

In another aspect, the bag is a backpack.

In another aspect, the securing mechanism can include at least one securing surface operable to secure the securing mechanism to the housing structure and at least one channel operable to receive and secure the display board.

In another aspect, the display board can include at least one guide, and wherein the at least one channel is operable to receive the at least one guide of the display board.

In another aspect, the securing mechanism can further include an abutment surface, and wherein the display board further includes an abutment shoulder, and wherein the abutment shoulder abuts the abutment surface when the display board is received and secured by the securing mechanism.

In one aspect, a backpack can include a housing structure of the backpack forming a cavity in the backpack, a display board removably secured to a board securing mechanism, wherein the board securing mechanism is disposed in the cavity in the backpack, and a display shell attached to the housing structure by a fastening mechanism, wherein the fastening mechanism is operable to transition the display shell between an open configuration and a closed configuration, wherein in the open configuration the display shell is positioned to allow access to the display board, and wherein in the closed configuration the display shell is positioned to prevent access to the display board.

In one aspect, a container can include a housing structure of the container forming a cavity in the container, a display board removably secured to a board securing mechanism, wherein the board securing mechanism is disposed in the cavity in the container, and a display shell attached to the housing structure by a fastening mechanism, wherein the fastening mechanism is operable to transition the display shell between an open configuration and a closed configuration, wherein in the open configuration the display shell is positioned to allow access to the display board, and wherein in the closed configuration the display shell is positioned to prevent access to the display board.

BRIEF DESCRIPTION OF THE DRAWINGS

The above-recited and other advantages and features of the present technology will become apparent by reference to specific implementations illustrated in the appended drawings. A person of ordinary skill in the art will understand that these drawings only show some examples of the present technology and would not limit the scope of the present technology to these examples. Furthermore, the skilled artisan will appreciate the principles of the present technology as described and explained with additional specificity and detail through the use of the accompanying drawings in which.

DETAILED DESCRIPTION

Various examples of the present technology are discussed in detail below. While specific implementations are discussed, it should be understood that this is done for illustration purposes only. A person skilled in the relevant art will recognize that other components and configurations may be used without parting from the spirit and scope of the present technology. In some instances, well-known structures and devices are shown in block diagram form in order to facilitate describing one or more aspects. Further, it is to be understood that functionality that is described as being carried out by certain system components may be performed by more or fewer components than shown.

Turning now to the figures, FIGS. 1-6 illustrate various views of an example bag and a display board disposed therein.

Figure 1:
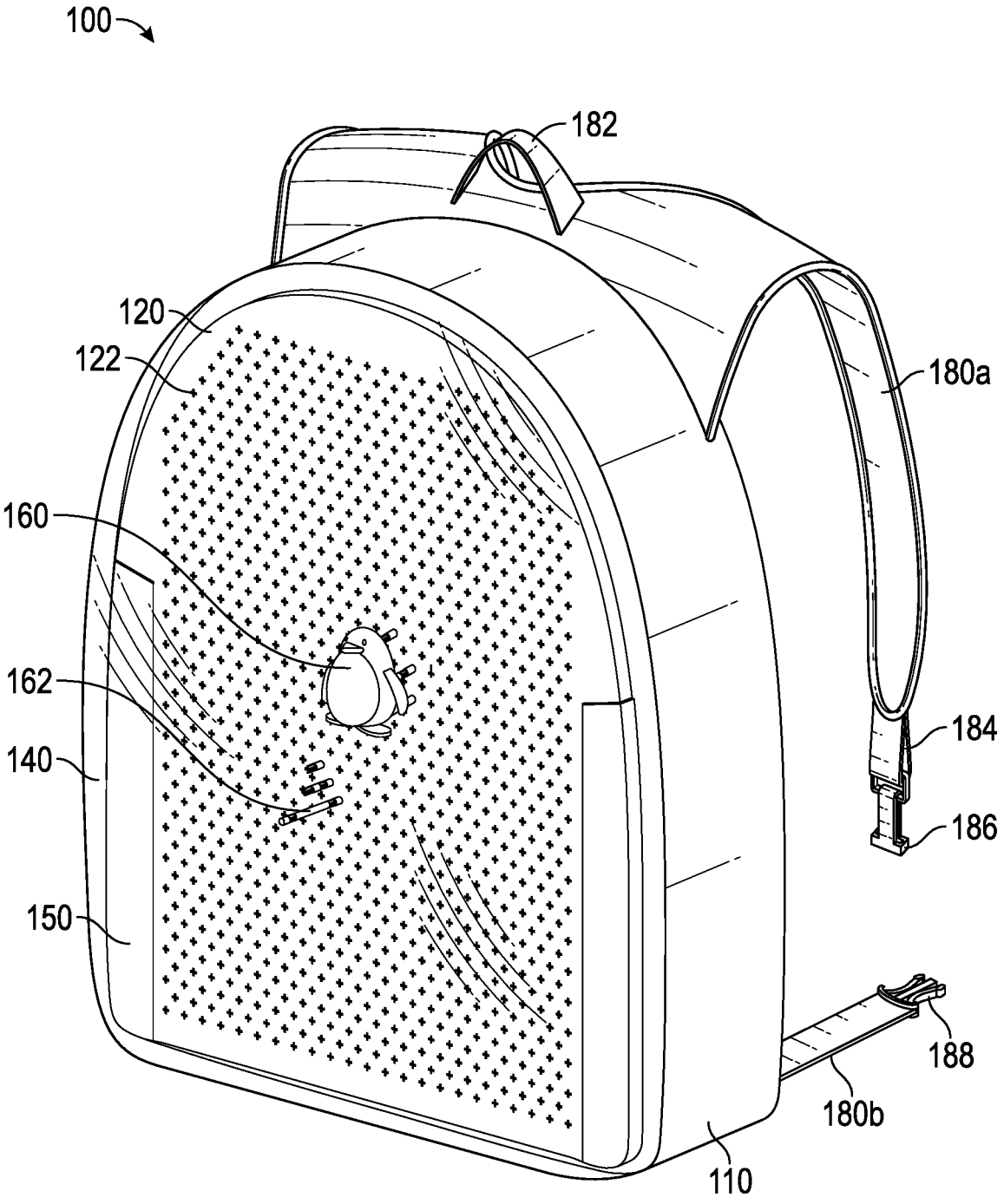
FIG. 1 shows a perspective view of an example bag in accordance with some aspects of the present disclosure.

FIG. 1 shows a perspective view of an example bag 100 in accordance with some aspects of the present disclosure. Bag 100 can include a housing structure 110, a display board 120, a display shell 140, board securing mechanism(s) 150, and strap portions 180*a*, 180*b* (collectively straps 180).

Housing structure 110 can be made of a resilient material that permits carrying various objects in bag 100. For example, housing structure 110 can be made of strong fabrics (e.g., a "soft-shell" bag), hard plastics (e.g., a "hard-shell" bag), nylon, canvas, leather, denim, etc. Although shown as a backpack, housing structure 110 can take any suitable shape or form to carry objects. For example, housing structure 110 can be shaped to be a briefcase, a suitcase, a messenger bag, a purse, a duffel, etc.

Display shell 140 can be made of a rigid material that protects contents within bag 100. For example, a hard plastic, such as acrylic, polycarbonate, and other materials. Additionally, display shell 140 may be a transparent shell operable to permit visibility of one or more objects disposed therein (e.g., a display board 120 and ornamental accessories 160 disposed thereon.

Board securing mechanism 150 removably secures display board 120 in bag 100. More specifically, board securing mechanism 150 removably secures display board 120 within a cavity defined by display shell 140 and housing structure 110.

Figure 2:
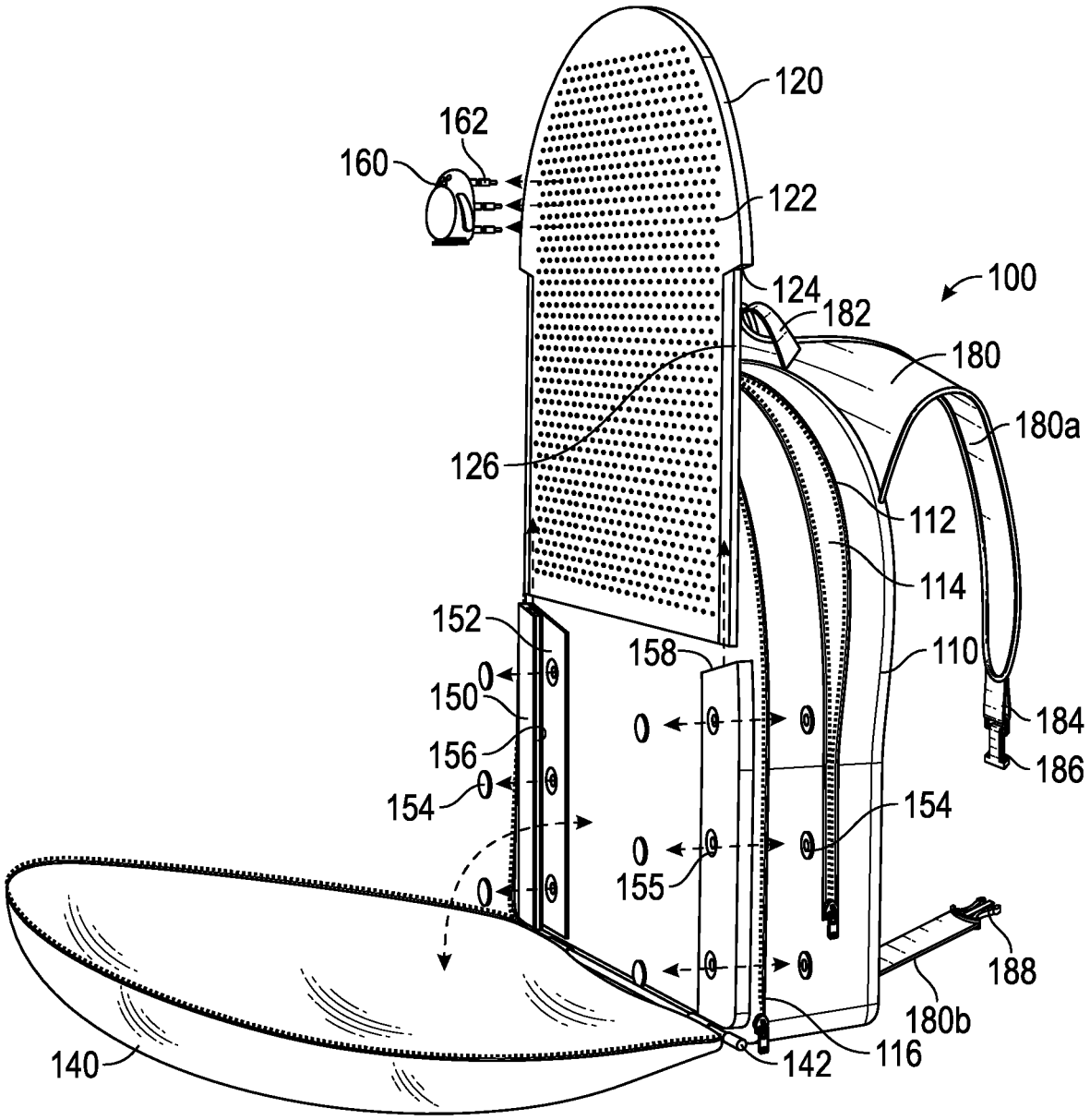
FIG. 2 shows an exploded view of an example bag in accordance with some aspects of the present disclosure.

FIG. 2 shows an exploded view of an example bag 100 in accordance with some aspects of the present disclosure.

Housing structure 110 can further include a first fastening mechanism 112, a cavity 114, a second fastening mechanism 116, a hinge mechanism 142.

First fastening mechanism 112 can transition between an open position and a closed position to allow access to first cavity 114. It is considered that first fastening mechanism 112 can also be replaced with other fastening mechanisms including, but not limited to, button and loop, buckles, magnets, etc.

Cavity 114 can provide a storage area for various objects, such as books, electronics, stationary, etc. Cavity 114 can be defined by housing structure 110. In some embodiments, cavity 114 can further be defined by display shell 140.

Second fastening mechanism 116 can be disposed along at least one wall of housing structure 110. Additionally, second fastening mechanism 116 is operable to permit access to second cavity portion 144. More specifically, second fastening mechanism 116 can transition between an open position and a closed position to allow access to display board 120. It is considered that second fastening mechanism 116 can also be replaced with other fastening mechanisms including, but not limited to, button and loop, buckles, magnets, etc.

Hinge mechanism 142 allows axial rotation along an axis defined along a length of hinge mechanism 142, such that display shell 140 can rotate between an open configuration and a closed configuration to control access to display board 120. In the open configuration, display shell 140 is positioned to allow access to display board 120. In the closed configuration, display shell 140 is positioned to prevent access to display board 120, while permitting visibility of display board 120 and ornamental accessories 160 disposed thereon.

Board securing mechanism(s) 150 can be attached onto housing structure 110. Board securing mechanism(s) 150 are operable to removably secure display board 120 to housing structure 110. Board securing mechanism(s) 150 can include a securing surface 152, fasteners 154, apertures 155, channels 156, and abutment surfaces 158.

Securing surface 152 provides a surface to secure board securing mechanism(s) 150 to housing structure 110. Additionally, securing surface 152 can include a surface for apertures 155, through which fasteners 154 can secure board securing mechanism(s) 150 to housing structure 110. Although described as fasteners 154 and apertures 155, it is to be understood that other methods of securing board securing mechanism(s) 150 to housing structure 110 can be used. For example, board securing mechanism(s) 150 can be secured to housing structure using complementary male and female buttons, zippers, rivets, sliding locks, friction fit (e.g., disposed in a complementarily sized recess of housing structure 110), co-molding, etc. In some embodiments, board securing mechanism(s) 150 can be integral with housing structure 110.

Channels 156 is operable to receive and guide ridges 126 of display board 120 into board securing mechanism 150. Channels 156 can be complementary to guides 126 to ensure smooth movement of guides 126 along channels 156 as display board 120 is installed into board securing mechanism 150.

Abutment surfaces 158 are operable to abut against an abutment shoulder 124 of display board 120 to properly position and removably secure display board 120 in board securing mechanism 150.

In some embodiments, display board 120 can divide cavity 114 into a first cavity portion 114 and a second cavity portion 144. First cavity portion 114 can defined by housing structure 110 and display board 120. Second cavity portion 144 can be defined by housing structure 110, display board 120, and display shell 140.

Although not shown, it is further contemplated that display board 120 can be a general L-shaped display board, such that the length of display board 120 extends in a similar manner as the display board 120 shown in FIG. 2 (e.g., a "vertical" portion of the L-shape). However, the L-shaped display board may extend in depth towards and under the cavity, such that the L-shaped display board can define first cavity portion 114 along at least two walls (e.g., a "horizontal" or "lower" portion of the L-shape). Additionally, it is further contemplated that display shell 140 can be longer in length to additionally allow access to the lower portion of the L-shaped display board. For example, hinge mechanism 142 can be moved to a rear surface of housing structure 110 (e.g., the surface with the straps), such that display shell 140 can axially rotate and moderate access to both the length of display board 120 and the depth of display board 120.

Figure 3:
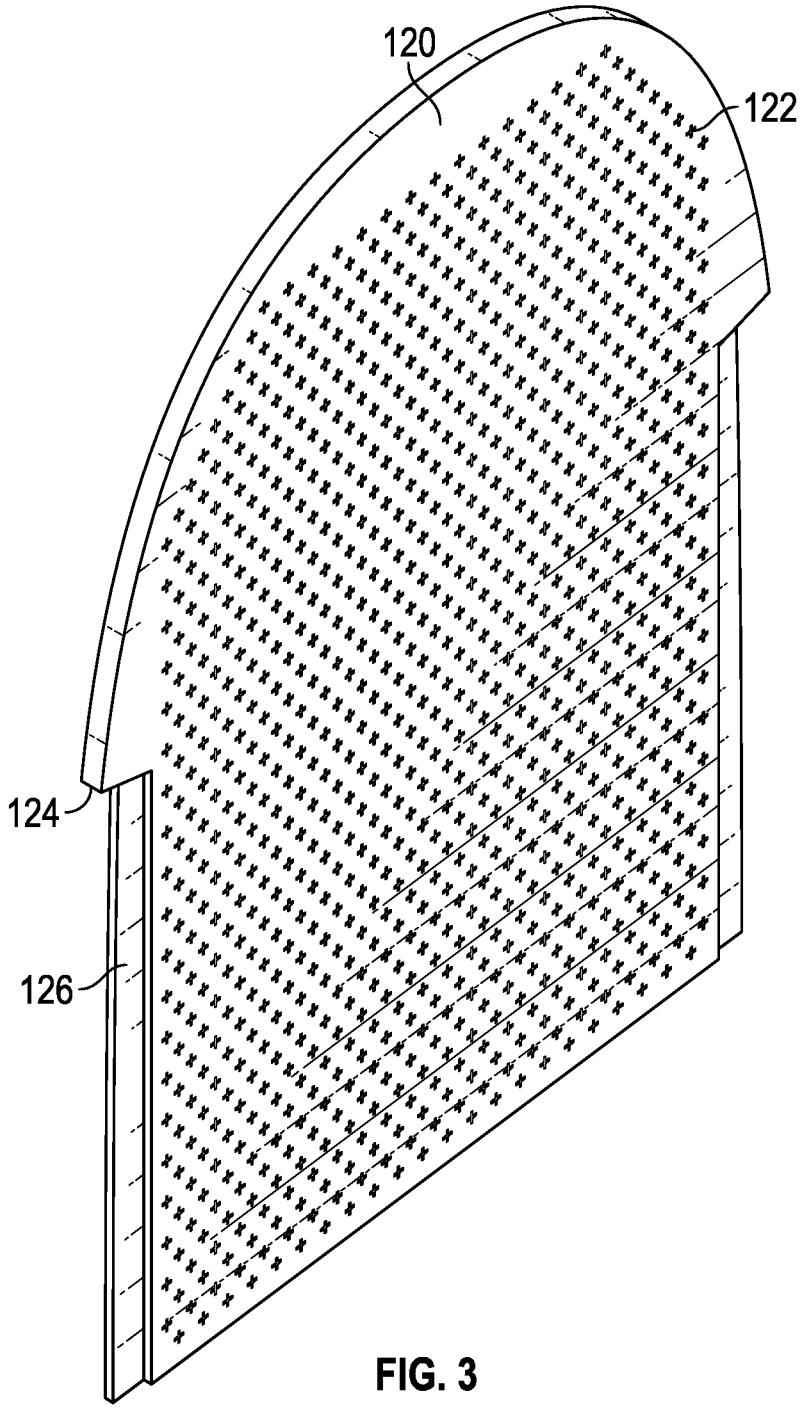
FIG. 3 shows a perspective view of an example display board in accordance with some aspects of the present disclosure.

FIG. 3 shows a perspective view of an example display board 120 in accordance with some aspects of the present disclosure. Display board 120 can be composed of a semi-rigid material, such that the material provides enough rigidity to maintain its structure but is flexible enough to not break or shatter from light pressure or impacts. Display board 120 can include a plurality of attachment points 122, abutment shoulder 124, and guides 126.

Attachment points 122 may be apertures operable to receive attachments (e.g., ornamental accessory 160). Attachment points 122 may be of a predetermined size, shape, and/or pattern, such that attachment points 122 can receive and removably secure a complementary structure fitting the predetermined size, shape, and/or pattern. For example, FIG. 3 illustrates attachment points 122 as a pattern of cross-shaped apertures, which are configured to receive and removably secure attachments with cross-shaped protrusions (e.g., via a friction fit). However, it is to be understood that attachment points 122 can be of any size, shape, and/or pattern along with a complementary structure. It is also contemplated that attachment points 122 can be attachment protrusions configured to be inserted into complementary apertures on attachments.

Abutment shoulders 124 are operable to abut against abutment surfaces 158 of board securing mechanism 150. More specifically, abutment shoulders 124 provide a stopping position for display board 120 as display board 120 is inserted into board securing mechanism 150.

Guides 126 may be a projection extending along at least a portion of a length of display board 120. Guides 126 can be inserted into channels 156 of board securing mechanism (s) 150 to guide display board 120 for proper positioning and securement of display board 120 by board securing mechanism(s) 150.

Figure 4:
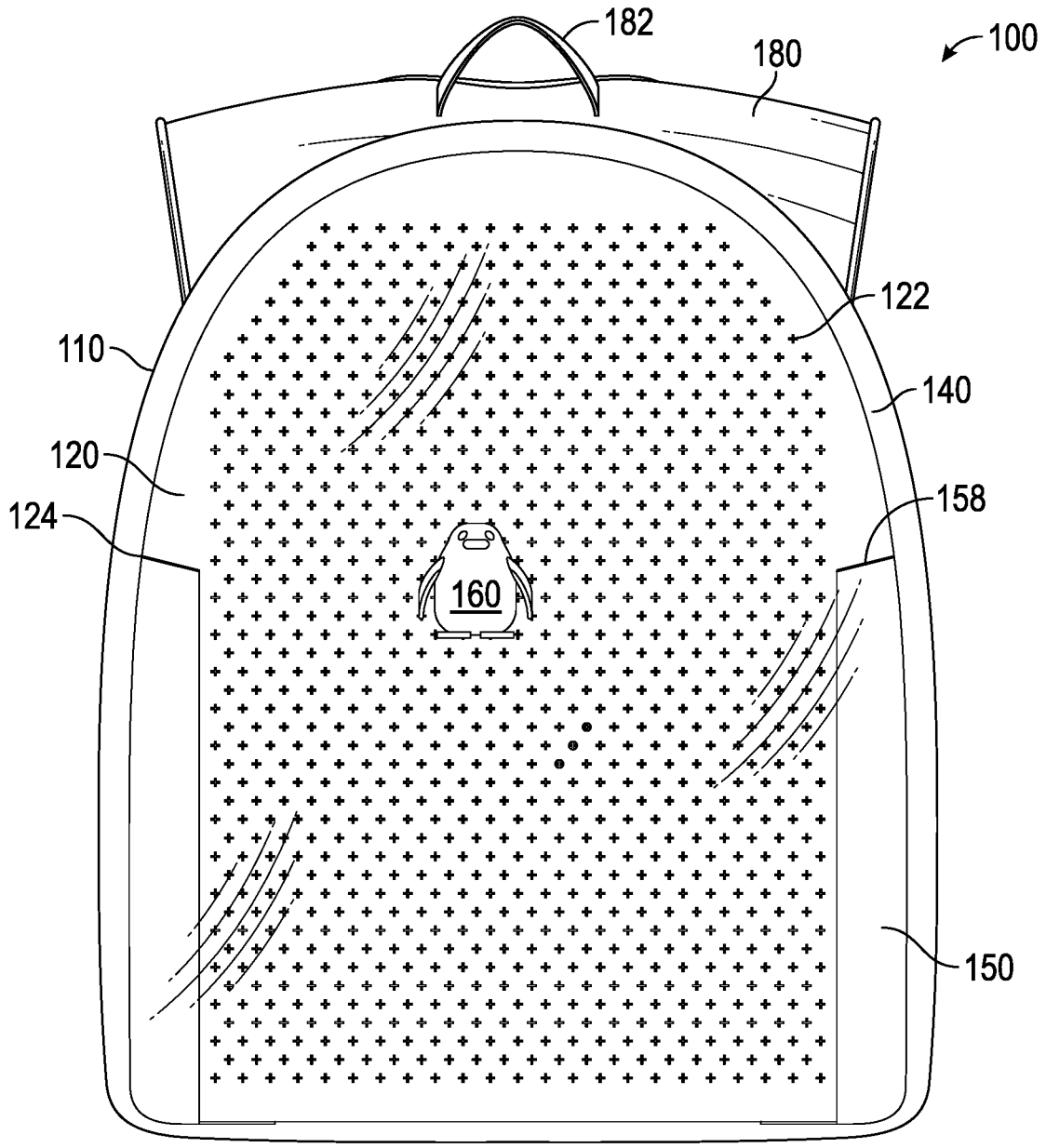
FIG. 4 shows a front view of an example bag in accordance with some aspects of the present disclosure.

FIG. 4 shows a front view of an example bag 100 in accordance with some aspects of the present disclosure. More specifically, FIG. 4 shows bag 100 and display shell 140 in a closed configuration, such that display board 120 is secured to board securing mechanism 150 and display shell 140 prevents access to display board 120 while permitting visibility of display board 120 and ornamental accessories 160 disposed thereon.

As discussed above, board securing mechanism(s) 150 are secured to housing structure 110. As shown in FIG. 4, board securing mechanism(s) 150 can receive and secure display board 120 thereto. When display board 120 is secured to board securing mechanism(s) 150, display board 120 is thereby secured to housing structure 110.

Figure 5:
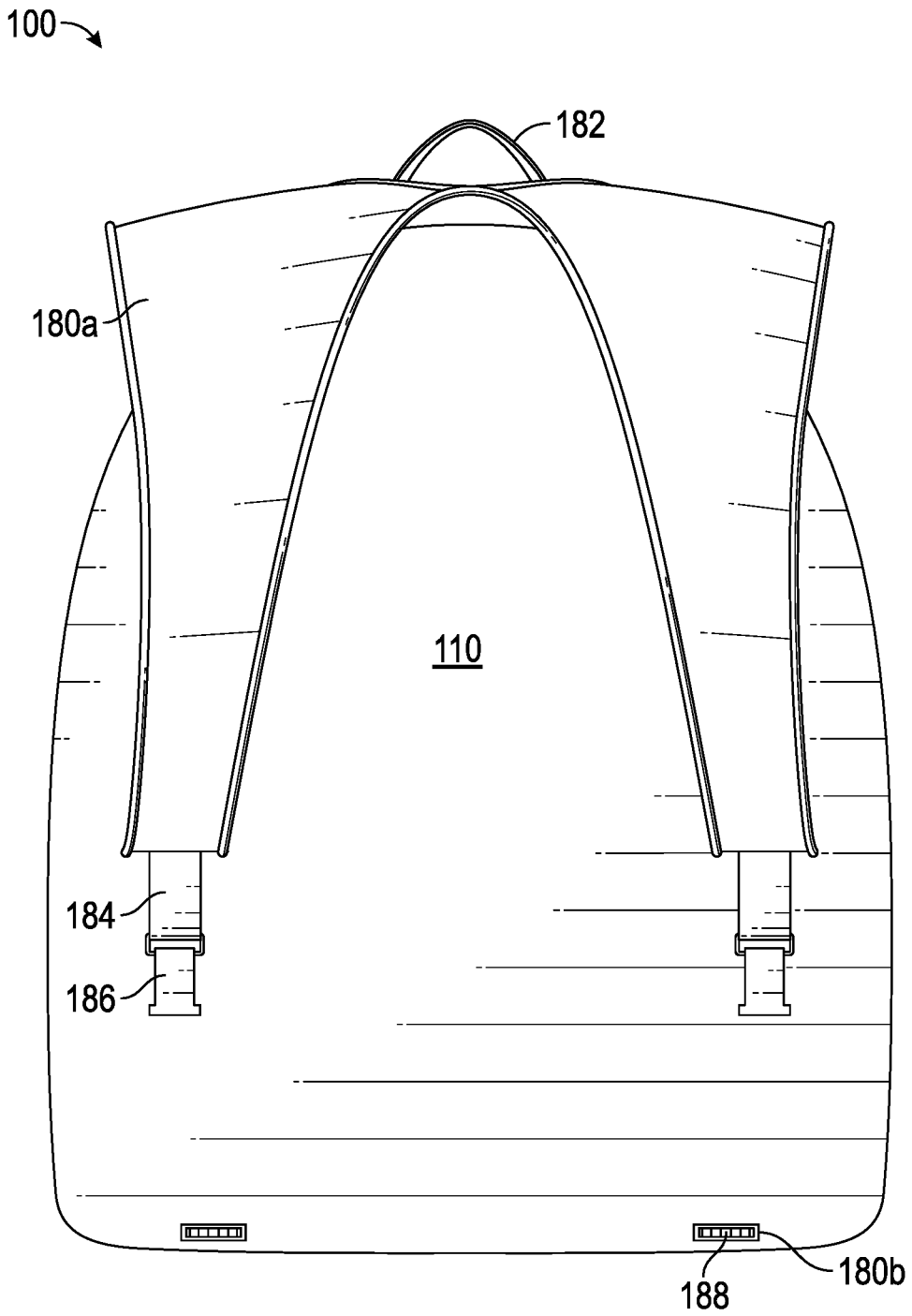
FIG. 5 shows a rear view of an example bag in accordance with some aspects of the present disclosure.

FIG. 5 shows a rear view of an example bag 100 in accordance with some aspects of the present disclosure. As discussed above, bag 100 can include straps 180 (illustrated as first strap portions 180*a* and second strap portions 180*b*) and a hanging loop 182.

Straps 180 can also include a first strap portion 180*a* and a second strap portion 180*b*. First strap portion 180*a* and second strap portion 180*b* are couplable to each other (e.g., via buckles 186 and 188). In some embodiments, strap portions 180*a*, 180*b* can include an extension 184 that can be used to adjust an overall length of straps 180. In some embodiments, strap portions 180*a*, 180*b* can individually be adjusted to adjust the overall length of straps 180. Although described as buckles 186 and 188, it is to be understood that other types of fasteners can be used to couple strap portions 180*a*, 180*b* including, but not limited to, clasps, catches, magnets, buttons, etc.

Hanging loop 182 is operable to hang bag 100 on a hook or other similar object. Hanging loop 182 can be disposed on an upper surface of housing structure 110 to permit upright hanging of bag 100. Hanging loop 182 can be made of similar or the same materials as housing structure 110.

Figure 6:
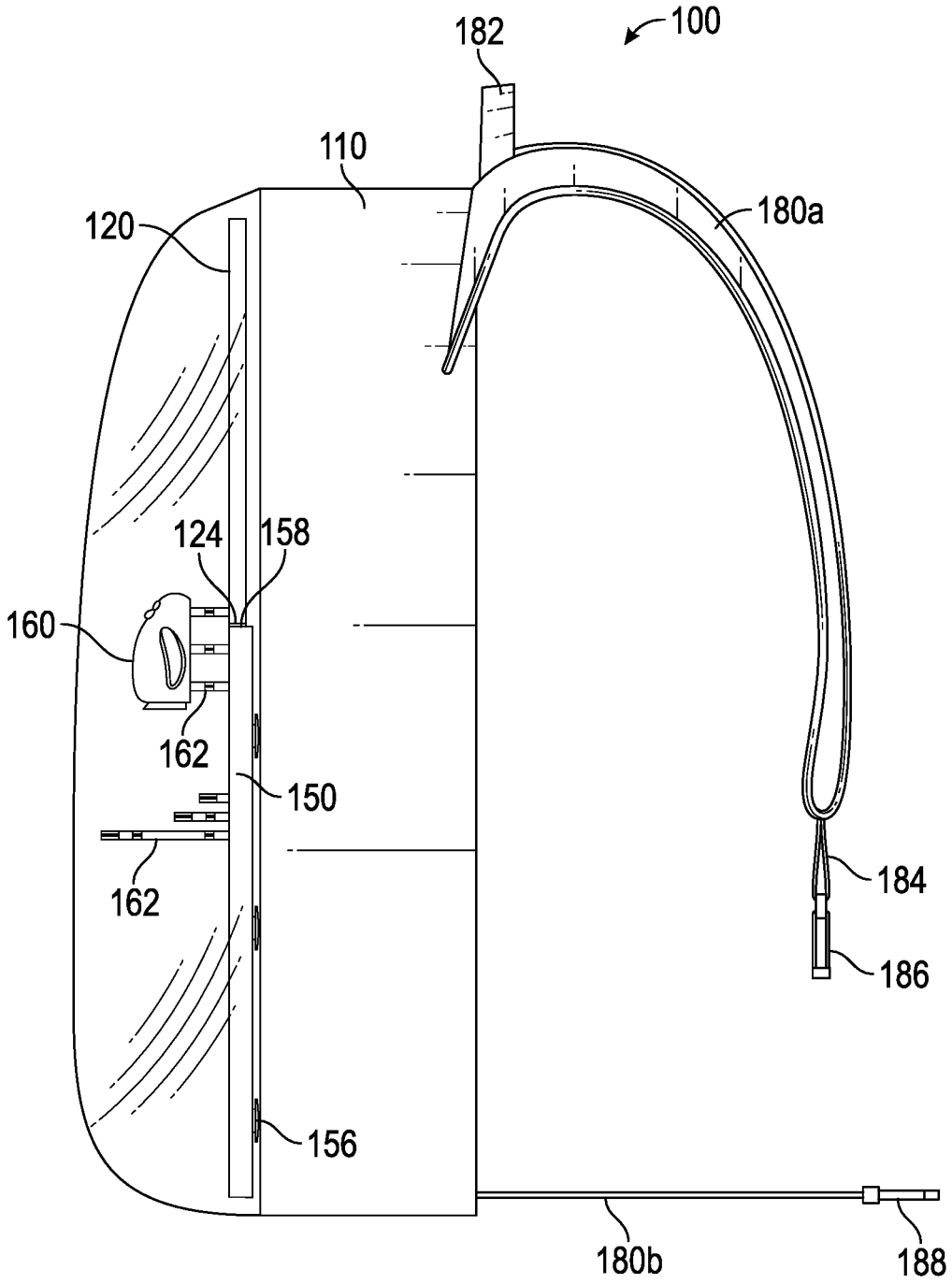
FIG. 6 shows a side view of an example bag in accordance with some aspects of the present disclosure.

FIG. 6 shows a side view of an example bag 100 in accordance with some aspects of the present disclosure. More specifically, FIG. 6 illustrates bag 100 in a closed configuration, such that display shell 140 is closed against housing structure 110, while permitting visibility through display shell 140 to view display board 120 and ornamental accessories 160 attached on display board 120. Additionally, abutment shoulder 124 of display board 120 abuts against abutment surface 158 when properly installed.

As further shown in FIG. 6, ornamental accessories 160 can be attached onto display board 120 via an attachment 162. Attachment 162 can include a protrusion shape that is complementary to attachment points 122 (as illustrated in FIG. 2). Thus, attachment 162 can attach (e.g., via a friction fit securement) to attachment points 122 and secure ornamental accessories 160 to display board 120.

The illustrations and examples provided herein are for explanatory purposes and are not intended to limit the scope of the appended claims. It will be recognized by those skilled in the art that changes or modifications may be made to the above described embodiment without departing from the broad inventive concepts of the present technology. It is understood therefore that the present technology is not limited to the particular embodiments which are described, but is intended to cover all modifications and changes within the scope and spirit of the present technology.

Illustrative examples of the disclosure include:

Aspect 1: A bag comprising: a housing structure of the bag forming a cavity in the bag; a display board removably secured to a board securing mechanism, wherein the board securing mechanism is disposed in the cavity in the bag; and a display shell attached to the housing structure by a fastening mechanism, wherein the fastening mechanism is operable to transition the display shell between an open configuration and a closed configuration, wherein in the open configuration the display shell is positioned to allow access to the display board, and wherein in the closed configuration the display shell is positioned to prevent access to the display board.

Aspect 2: The bag of Aspect 1, wherein the display board divides the cavity into a first cavity portion and a second cavity portion, wherein the first cavity portion is defined by the housing structure, the display board, and the display shell, and wherein the bag further comprises: a second fastening mechanism along at least one wall of the housing structure, wherein the second fastening mechanism is operable to permit access to the second cavity portion, wherein the second cavity portion is defined by the housing structure and the display board.

Aspect 3: The bag of any of Aspect 1 to 2, wherein the display shell is transparent.

Aspect 4: The bag of any of Aspect 1 to 3, wherein the display board includes a plurality of attachment points disposed thereon, wherein the plurality of attachment points are configured to receive and secure an ornamental accessory to the display board.

Aspect 5: The bag of any of Aspect 1 to 4, further comprising: a hinge mechanism disposed on the housing structure, the hinge mechanism configured to rotate the display shell between the open configuration and the closed configuration by axial rotation along an axis defined along a length of the hinge mechanism.

Aspect 6: The bag of any of Aspect 1 to 5, wherein the bag is a suitcase.

Aspect 7: The bag of any of Aspect 1 to 5, wherein the bag is a backpack.

Aspect 8: The bag of any of Aspect 1 to 7, wherein the securing mechanism includes: at least one securing surface operable to secure the securing mechanism to the housing structure; and at least one channel operable to receive and secure the display board.

Aspect 9: The bag of any of Aspect 1 to 8, wherein the display board includes at least one guide, and wherein the at least one channel is operable to receive the at least one guide of the display board.

Aspect 10: The bag of any of Aspect 1 to 9, wherein the securing mechanism further includes an abutment surface, and wherein the display board further includes an abutment shoulder, and wherein the abutment shoulder abuts the abutment surface when the display board is received and secured by the securing mechanism.

Aspect 11: A backpack comprising: a housing structure of the backpack forming a cavity in the backpack; a display board removably secured to a board securing mechanism, wherein the board securing mechanism is disposed in the cavity in the backpack; and a display shell attached to the housing structure by a fastening mechanism, wherein the fastening mechanism is operable to transition the display shell between an open configuration and a closed configuration, wherein in the open configuration the display shell is positioned to allow access to the display board, and wherein in the closed configuration the display shell is positioned to prevent access to the display board.

Aspect 12: The backpack of Aspect 11, wherein the display board divides the cavity into a first cavity portion and a second cavity portion, wherein the first cavity portion is defined by the housing structure, the display board, and the display shell, and wherein the backpack further comprises: a second fastening mechanism along at least one wall of the housing structure, wherein the second fastening mechanism is operable to permit access to the second cavity portion, wherein the second cavity portion is defined by the housing structure and the display board.

Aspect 13: The backpack of any of Aspect 11 to 12, wherein the display shell is transparent.

Aspect 14: The backpack of any of Aspect 11 to 13, wherein the display board includes a plurality of attachment points disposed thereon, wherein the plurality of attachment points are configured to receive and secure an ornamental accessory to the display board.

Aspect 15: The backpack of any of Aspect 11 to 14, further comprising: a hinge mechanism disposed on the housing structure, the hinge mechanism configured to rotate the display shell between the open configuration and the closed configuration by axial rotation along an axis defined along a length of the hinge mechanism.

Aspect 16: The backpack of any of Aspect 1 to 15, wherein the securing mechanism includes: at least one securing surface operable to secure the securing mechanism to the housing structure; and at least one channel operable to receive and secure the display board.

Aspect 17: The backpack of any of Aspect 11 to 16, wherein the display board includes at least one guide, and wherein the at least one channel is operable to receive the at least one guide of the display board.

Aspect 18: The backpack of any of Aspect 11 to 17, wherein the securing mechanism further includes an abutment surface, and wherein the display board further includes an abutment shoulder, and wherein the abutment shoulder abuts the abutment surface when the display board is received and secured by the securing mechanism.

Aspect 19: A container comprising: a housing structure of the container forming a cavity in the container; a display board removably secured to a board securing mechanism, wherein the board securing mechanism is disposed in the cavity in the container; and a display shell attached to the housing structure by a fastening mechanism, wherein the fastening mechanism is operable to transition the display shell between an open configuration and a closed configuration, wherein in the open configuration the display shell is positioned to allow access to the display board, and wherein in the closed configuration the display shell is positioned to prevent access to the display board.

Aspect 20: The container of Aspect 19, wherein the display board divides the cavity into a first cavity portion and a second cavity portion, wherein the first cavity portion is defined by the housing structure, the display board, and the display shell, and wherein the container further comprises: a second fastening mechanism along at least one wall of the housing structure, wherein the second fastening mechanism is operable to permit access to the second cavity portion, wherein the second cavity portion is defined by the housing structure and the display board.

Aspect 21: The container of any of Aspect 19 to 20, wherein the display shell is transparent.

Aspect 22: The container of any of Aspect 19 to 21, wherein the display board includes a plurality of attachment points disposed thereon, wherein the plurality of attachment points are configured to receive and secure an ornamental accessory to the display board.

Aspect 23: The container of any of Aspect 19 to 22, further comprising: a hinge mechanism disposed on the housing structure, the hinge mechanism configured to rotate the display shell between the open configuration and the closed configuration by axial rotation along an axis defined along a length of the hinge mechanism.

Aspect 24: The container of any of Aspect 19 to 23, wherein the container is a suitcase.

Aspect 25: The container of any of Aspect 19 to 23, wherein the container is a backpack.

Aspect 26: The container of any of Aspect 19 to 25, wherein the securing mechanism includes: at least one securing surface operable to secure the securing mechanism to the housing structure; and at least one channel operable to receive and secure the display board.

Aspect 27: The container of any of Aspect 19 to 26, wherein the display board includes at least one guide, and wherein the at least one channel is operable to receive the at least one guide of the display board.

Aspect 28: The container of any of Aspect 19 to 27, wherein the securing mechanism further includes an abutment surface, and wherein the display board further includes an abutment shoulder, and wherein the abutment shoulder abuts the abutment surface when the display board is received and secured by the securing mechanism.

What is claimed is:

1. A bag comprising:

a housing structure of the bag forming a cavity in the bag;

a display board removably secured to a board securing mechanism, wherein the board securing mechanism is disposed in the cavity in the bag;

a display shell attached to the housing structure by a fastening mechanism, wherein the fastening mechanism is operable to transition the display shell between an open configuration and a closed configuration, wherein in the open configuration the display shell is positioned to allow access to the display board, and wherein in the closed configuration the display shell is positioned to prevent access to the display board, wherein the display board divides the cavity into a first cavity portion and a second cavity portion, wherein the first cavity portion is defined by the housing structure, the display board, and the display shell; and a second fastening mechanism along at least one wall of the housing structure, wherein the second fastening mechanism is operable to permit access to the second cavity portion, wherein the second cavity portion is defined by the housing structure and the display board.

2. The bag of claim 1, wherein the display shell is transparent.

3. The bag of claim 1, wherein the display board includes a plurality of attachment points disposed thereon, wherein the plurality of attachment points are configured to receive and secure an ornamental accessory to the display board.

4. The bag of claim 1, further comprising:

a hinge mechanism disposed on the housing structure, the hinge mechanism configured to rotate the display shell between the open configuration and the closed configuration by axial rotation along an axis defined along a length of the hinge mechanism.

5. The bag of claim 1, wherein the bag is a suitcase.

6. The bag of claim 1, wherein the bag is a backpack.

7. The bag of claim 1, wherein the securing mechanism includes:

at least one securing surface operable to secure the securing mechanism to the housing structure; and at least one channel operable to receive and secure the display board.

8. The bag of claim 7, wherein the display board includes at least one guide, and wherein the at least one channel is operable to receive the at least one guide of the display board.

9. The bag of claim 7, wherein the securing mechanism further includes an abutment surface, and wherein the display board further includes an abutment shoulder, and wherein the abutment shoulder abuts the abutment surface when the display board is received and secured by the securing mechanism.

10. A backpack comprising:

a housing structure of the backpack forming a cavity in the backpack;

a display board removably secured to a board securing mechanism, wherein the board securing mechanism is disposed in the cavity in the backpack; and a display shell attached to the housing structure by a fastening mechanism, wherein the fastening mechanism is operable to transition the display shell between an open configuration and a closed configuration, wherein in the open configuration the display shell is positioned to allow access to the display board, and wherein in the closed configuration the display shell is positioned to prevent access to the display board, wherein the display board divides the cavity into a first cavity portion and a second cavity portion, wherein the first cavity portion is defined by the housing structure, the display board, and the display shell; and a second fastening mechanism along at least one wall of the housing structure, wherein the second fastening mechanism is operable to permit access to the second cavity portion, wherein the second cavity portion is defined by the housing structure and the display board.

11. The backpack of claim 10, wherein the display shell is transparent.

12. The backpack of claim 10, wherein the display board includes a plurality of attachment points disposed thereon, wherein the plurality of attachment points are configured to receive and secure an ornamental accessory to the display board.

13. The backpack of claim 10, further comprising:

a hinge mechanism disposed on the housing structure, the hinge mechanism configured to rotate the display shell between the open configuration and the closed configuration by axial rotation along an axis defined along a length of the hinge mechanism.

14. The backpack of claim 10, wherein the securing mechanism includes:

at least one securing surface operable to secure the securing mechanism to the housing structure; and at least one channel operable to receive and secure the display board.

15. The backpack of claim 14, wherein the display board includes at least one guide, and wherein the at least one channel is operable to receive the at least one guide of the display board.

16. The backpack of claim 14, wherein the securing mechanism further includes an abutment surface, and wherein the display board further includes an abutment shoulder, and wherein the abutment shoulder abuts the abutment surface when the display board is received and secured by the securing mechanism.

17. A container comprising:

a housing structure of the container forming a cavity in the container;

a display board removably secured to a board securing mechanism, wherein the board securing mechanism is disposed in the cavity in the container; and a display shell attached to the housing structure by a fastening mechanism, wherein the fastening mechanism is operable to transition the display shell between an open configuration and a closed configuration, wherein in the open configuration the display shell is positioned to allow access to the display board, and wherein in the closed configuration the display shell is positioned to prevent access to the display board, wherein the display board divides the cavity into a first cavity portion and a second cavity portion, wherein the first cavity portion is defined by the housing structure, the display board, and the display shell; and a second fastening mechanism along at least one wall of the housing structure, wherein the second fastening mechanism is operable to permit access to the second cavity portion, wherein the second cavity portion is defined by the housing structure and the display board.

* * * * *